US009856675B2

(12) United States Patent
Ilardo et al.

(10) Patent No.: US 9,856,675 B2
(45) Date of Patent: Jan. 2, 2018

(54) SAFETY DEVICE FOR VEHICLE DOOR HANDLE

(71) Applicant: VALEO SPA, Santena (IT)

(72) Inventors: Simone Ilardo, Santena (IT); Vittorio Giaccone, Santena (IT)

(73) Assignee: U-SHIN ITALIA S.P.A., Pianezza (IT)

( * ) Notice: Subject to any disclaimer, the term of this patent is extended or adjusted under 35 U.S.C. 154(b) by 303 days.

(21) Appl. No.: 14/367,387

(22) PCT Filed: Dec. 21, 2012

(86) PCT No.: PCT/EP2012/076833

§ 371 (c)(1),
(2) Date: Jun. 20, 2014

(87) PCT Pub. No.: WO2013/093092

PCT Pub. Date: Jun. 27, 2013

(65) Prior Publication Data

US 2014/0312633 A1 Oct. 23, 2014

(30) Foreign Application Priority Data

Dec. 22, 2011 (IT) ..... MI2011A2367

(51) Int. Cl.
*E05B 3/00* (2006.01)
*E05B 7/00* (2006.01)
(Continued)

(52) U.S. Cl.
CPC ..... *E05B 7/00* (2013.01); *E05B 77/06* (2013.01); *E05B 77/42* (2013.01); *E05B 85/16* (2013.01);
(Continued)

(58) Field of Classification Search
CPC ..... Y10T 292/57; E05B 7/00; E05B 77/06; E05B 77/42; E05B 85/16; E05B 63/0056
(Continued)

(56) References Cited

U.S. PATENT DOCUMENTS 3,719,248 A * 3/1973 Breitschwerdt ..... E05B 77/06 180/271
5,860,684 A * 1/1999 Mizuki ..... E05B 83/36 292/336.3
(Continued)

FOREIGN PATENT DOCUMENTS

DE 199 01 279 A1 7/2000
EP 1 010 846 A1 6/2000
(Continued)

OTHER PUBLICATIONS

International Search Report for corresponding International Application No. PCT/EP2012/076833, dated Apr. 24, 2013 (3 pages).

*Primary Examiner* — Kristina R Fulton
*Assistant Examiner* — Faria F Ahmad
(74) *Attorney, Agent, or Firm* — Osha Liang LLP

(57) ABSTRACT

The present invention is related to a vehicle door handle, comprising an inertial system (17) mobile in rotation around a main rotation axis (A) and configured for activating and preventing the actuation of the door handle (1), the said inertial system (17) comprising a body (23) receiving the main rotation axis (A) and a mobile part (25) comprising an inertial mass (27), the mobile part (25) being mobile in rotation relative to the body (23) around a secondary axis (A,B) sensibly parallel to the main rotation axis (A), the inertial system (17) also comprising means for stopping the rotation of the mobile part (25) in a predetermined direction.

10 Claims, 5 Drawing Sheets

Figure 1:
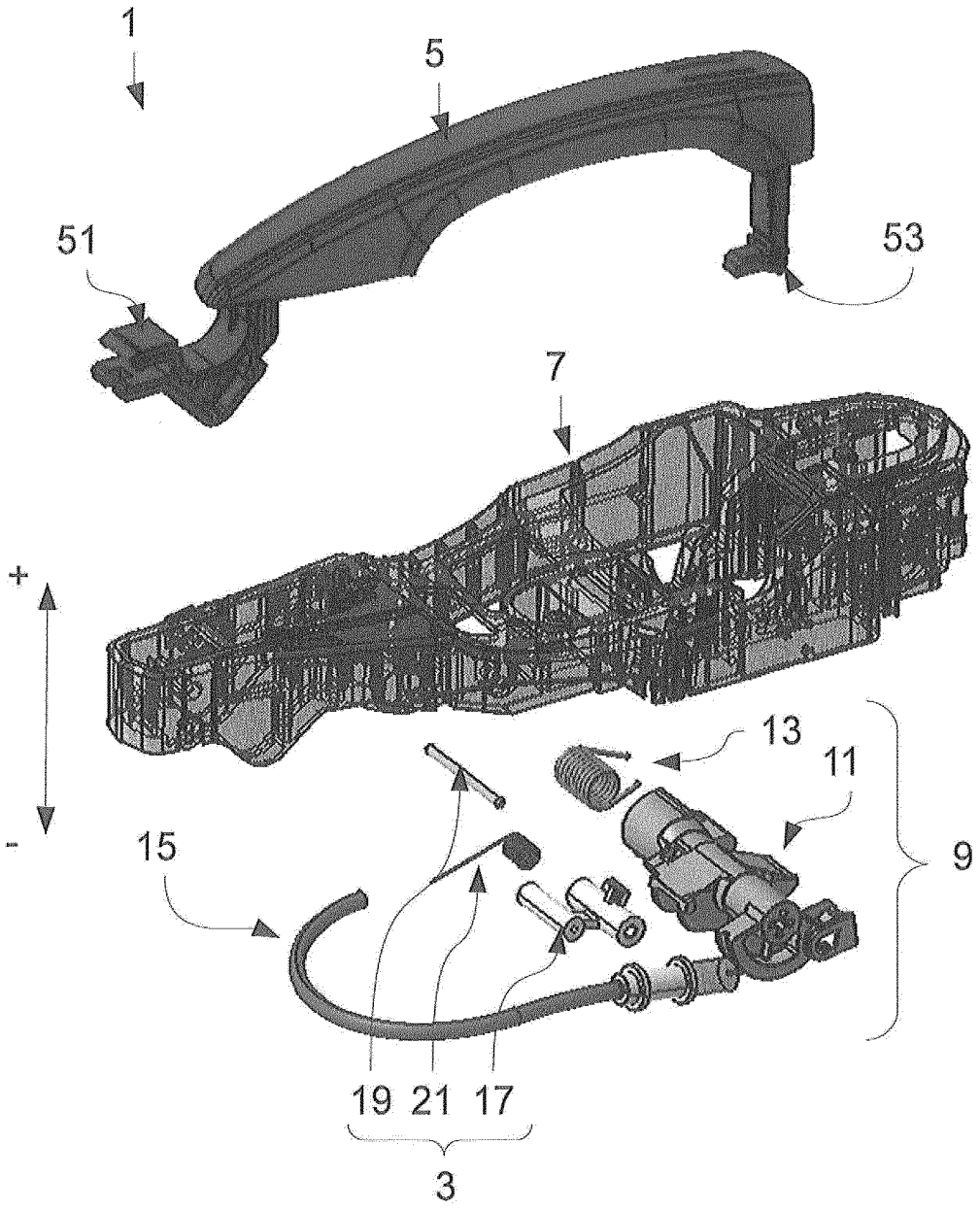

(51) Int. Cl.
*E05B 77/06* (2014.01)
*E05B 77/42* (2014.01)
*E05B 85/16* (2014.01)
*E05B 63/00* (2006.01)

(52) U.S. Cl.
CPC ..... *E05B 63/0056* (2013.01); *Y10T 292/57* (2015.04)

(58) Field of Classification Search
USPC ..... 292/336.3, DIG. 22
See application file for complete search history.

(56) References Cited

U.S. PATENT DOCUMENTS 5,887,918 A * 3/1999 Okada ..... E05B 85/10 292/141
5,975,597 A * 11/1999 Makiuchi ..... E05B 85/16 292/336.3
6,007,122 A * 12/1999 Linder ..... E05B 85/10 292/216
6,554,331 B2 * 4/2003 Ciborowski ..... E05B 85/16 292/366.3
6,709,033 B2 * 3/2004 Jooss ..... E05B 77/06 16/412
6,874,829 B2 * 4/2005 Muller ..... E05B 85/12 292/336.3
7,029,042 B2 * 4/2006 Belchine, III ..... E05B 77/06 292/230
7,070,216 B2 * 7/2006 von zur Muehlen ... E05B 77/06 292/336.3
7,597,368 B2 * 10/2009 Savant ..... E05B 77/06 292/336.3
7,677,614 B2 * 3/2010 Monig ..... E05B 85/16 292/336.3
8,152,209 B2 * 4/2012 Lee ..... E05B 77/06 292/336.3
8,424,936 B2 * 4/2013 Muller ..... E05B 85/16 292/336.3
8,469,411 B2 * 6/2013 Costigan ..... E05B 85/16 292/336.3
8,727,402 B2 * 5/2014 Bejune ..... E05B 77/04 292/336.3
8,840,156 B2 * 9/2014 Savant ..... A47B 47/0008 292/336.3
8,959,964 B2 * 2/2015 Hidaka ..... E05B 79/06 292/336.3
8,966,826 B2 * 3/2015 Kudoh ..... E05B 79/06 292/336.3
9,062,477 B2 * 6/2015 Da Deppo ..... E05B 77/06
2003/0001399 A1 * 1/2003 Sato ..... E05B 79/06 292/336.3
2003/0011202 A1 * 1/2003 Kwak ..... E05B 79/06 292/336.3
2004/0232710 A1 * 11/2004 Jooss ..... E05B 81/78 292/336.3
2005/0093306 A1 * 5/2005 Pudney ..... E05B 85/16 292/216
2005/0161959 A1 * 7/2005 Belchine, III ..... E05B 77/06 292/336.3
2006/0038418 A1 * 2/2006 Huizenga ..... E05B 77/06 292/336.3
2006/0049647 A1 * 3/2006 von zur Muehlen ... E05B 77/06 292/336.3
2007/0138812 A1 * 6/2007 Kondo ..... E05B 85/16 292/336.3
2007/0158959 A1 * 7/2007 Sakamoto ..... E05B 77/06 292/336.3
2008/0036219 A1 * 2/2008 Savant ..... E05B 77/06 292/336.3
2008/0277948 A1 * 11/2008 Takaya ..... E05B 85/16 292/336.3
2009/0026774 A1 * 1/2009 Watanabe ..... E05B 77/06 292/336.3
2009/0223263 A1 9/2009 Puscas et al.
2010/0171327 A1 * 7/2010 Muller ..... E05B 85/16 292/336.3
2010/0225127 A1 * 9/2010 Muller ..... E05B 85/16 292/336.3
2011/0115240 A1 * 5/2011 Muller ..... E05B 77/06 292/336.3
2011/0163554 A1 7/2011 Patel
2011/0298228 A1 * 12/2011 Lesueur ..... E05B 77/06 292/336.3
2012/0267905 A1 * 10/2012 Debroucke ..... E05B 15/04 292/336.3
2013/0170241 A1 * 7/2013 Lesueur ..... E05B 77/06 362/501
2013/0187394 A1 * 7/2013 Lesueur ..... E05B 77/06 292/336.3
2013/0221690 A1 * 8/2013 Rocci ..... E05B 77/06 292/336.3
2013/0234455 A1 * 9/2013 Rocci ..... E05B 85/16 292/336.3
2014/0145454 A1 * 5/2014 Da Deppo ..... E05B 77/06 292/336.3
2014/0167427 A1 * 6/2014 Corwin ..... E05B 85/10 292/336.3
2014/0367977 A1 * 12/2014 Beck ..... E05B 85/14 292/336.3
2014/0375068 A1 * 12/2014 Niegeloh ..... E05B 7/00 292/336.3
2014/0375069 A1 * 12/2014 Niegeloh ..... E05B 85/16 292/336.3
2015/0054295 A1 * 2/2015 Nam ..... E05B 77/06 292/336.3
2015/0069767 A1 * 3/2015 Nam ..... E05B 77/06 292/336.3
2015/0167362 A1 * 6/2015 Kang ..... E05B 85/16 292/336.3
2015/0176305 A1 * 6/2015 Jeong ..... E05B 1/0038 292/336.3
2015/0184431 A1 * 7/2015 Da Deppo ..... E05B 85/10 292/336.3
2015/0191942 A1 * 7/2015 Ilardo ..... E05B 77/06 292/336.3
2015/0322699 A1 * 11/2015 Ilardo ..... E05B 77/06 292/336.3

FOREIGN PATENT DOCUMENTS

WO 2008/068262 A1 6/2008
WO 2010/003881 A1 1/2010
WO 2010/037622 A1 4/2010
WO 2010/133372 A1 11/2010

* cited by examiner

SAFETY DEVICE FOR VEHICLE DOOR HANDLE

The invention relates to a safety device for a vehicle door handle, in particular in order to avoid unsolicited opening of said door during a side crash scenario.

When a vehicle undergoes a lateral collision, the inertia of the handle pieces can lead to an actuation of the door latch. Major risk in that case is the opening of the door, meaning that the occupants are directly exposed to the outside, while free objects can be thrown out of the vehicle.

It is known to use movement prevention devices, actuated by the important accelerations often of several tens of g that lock the handle to avoid opening of the vehicle door. Most commonly, said movement prevention devices use an inertial mass which is moved by the change in inertia so as to enter a blocking position. In said blocking position, blocking means engage with the latch or handle mechanics in a way that prevents opening of the door.

The known movement prevention devices can be divided in two main categories: temporary blocking and permanent blocking The temporary blocking devices use returning means such as a spring to bring back the inertial mass in a non-blocking position as soon as the acceleration diminishes beyond a reasonable value. The permanent blocking devices have no means to bring back the inertial mass in the non-blocking position, and often comprise in addition means to keep the blocking means engaged with the latch or handle mechanics even after the crash subsequent accelerations are gone.

The temporary blocking devices ensure that a rescuer or everyone who will activate the external handle can open the door once the vehicle has stabilized itself for pulling the occupants of the vehicle out. The problem with said temporary blocking devices is that vibrations and the inertia oscillations due to rebounds of the vehicle or to secondary impacts are likely to free the blocking means of the movement blocking device from the handle mechanism.

Permanent blocking devices are more effective in keeping the door closed during the crash, but the latches or handles remain blocked in locked state even when the doors could be opened safely again.

Damped inertial systems use a temporary blocking architecture, in which a rotational damper selectively delays the return to the non-blocking position of the movement prevention device. Movement prevention devices using damped inertial systems combine the advantages of both permanent and temporary blocking devices. During the crash the movement prevention device is maintained in blocking position during the risk time interval, and returns to non-blocking position afterward, allowing easy evacuation of the vehicle.

In the case of damped inertial devices, the major risk is that in case of violent rebound inertial forces may overcome the damper and force the movement prevention device back in a non-blocking position while still in the risk time interval. With not damped temporary blocking devices, the rebounds may bring the device back in a non-blocking position even likelier since no damper opposes to the inertial forces.

In order to overcome at least partially the aforementioned drawbacks, the invention has for object a vehicle door handle, comprising an inertial system mobile in rotation around a main rotation axis and configured for activating and preventing the actuation of the door handle, the said inertial system comprising a body receiving the main rotation axis and a mobile part comprising an inertial mass, the mobile part being mobile in rotation relative to the body around a secondary axis sensibly parallel to the main rotation axis, the inertial system also comprising means for stopping the rotation of the mobile part in a predetermined direction.

The door handle according to the invention allows the inertial mass to move freely in the direction of the rest position without driving the body and thus the inertial system in a door handle freeing position in case of rebound conditioned inertial forces.

The door handle can also have one or more of the following characteristics, taken separately or in combination.

- the blocking means for stopping the rotation of the mobile part comprise a stopper located on the side of the body and configured for blocking the movement of the mobile part,
- the inertial system is mobile in rotation around a main rotation axis between a locking angular domain in which blocking means of said inertial system interfere with an opening mechanism to prevent actuating the door handle, and a rest angular domain in which the door handle can be freely actuated, and elastic means are configured to bring the inertial system back to its rest angular domain in absence of acceleration,
- the body comprises a primary arm, said primary arm extending radially from the cylindrical body, the cylindrical body also carries the blocking means, the mobile part being an arm hinged to the secondary axis and extending radially from said axis, the inertial mass being supported at the free end of the arm, the stopper being located on the side of the cylindrical body configured to engage with the arm when said arm is moving in direction of the locking angular domain, and to let the arm move freely in the direction of the rest angular domain,
- the stopper comprises a shoulder extending radially from the cylindrical body,
- the secondary axis and the main rotation axis of the inertial system are the same,
- the arm being carried by a ring shaped base, coaxial to and surrounding the cylindrical body,
- the vehicle door handle further comprises a rotational damper, configured to temporize the return of the inertial system from the locking angular domain to the rest angular domain,
- the damper mechanism is a rotational damper integrated in the cylindrical body,
- the elastic means comprise a coil spring surrounding the cylindrical body,
- the primary arm and the arm carrying the inertial mass are at an obtuse or reflex angle, the direction perpendicular to the door plane and pointing outwards being approximately a bisector of said angle,
- the angle between the primary arm and arm carrying the inertial mass is of about 160°,
- the inertial mass comprises a socket in which a pin can be inserted to tune the weight of inertial mass (27).

Figure 2A:
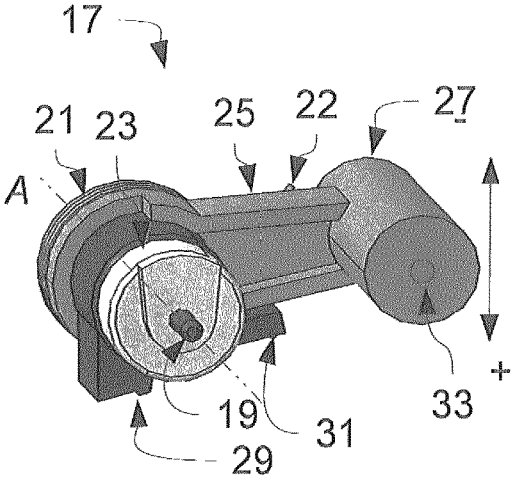
Figure 2B:
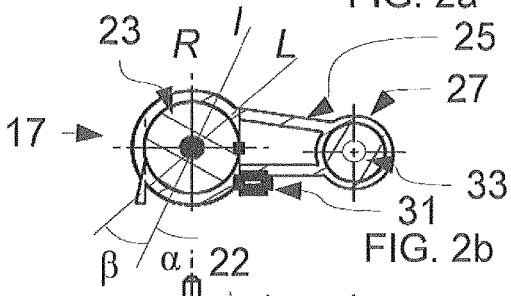
Figure 2C:
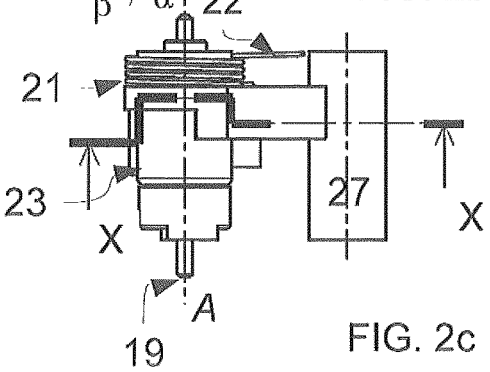
Figure 4A:
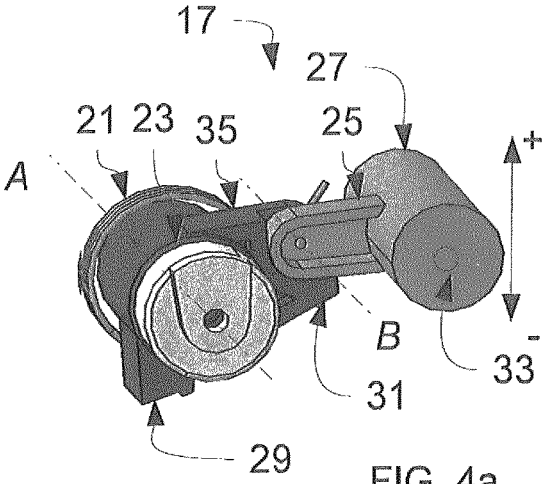
Figure 4B:
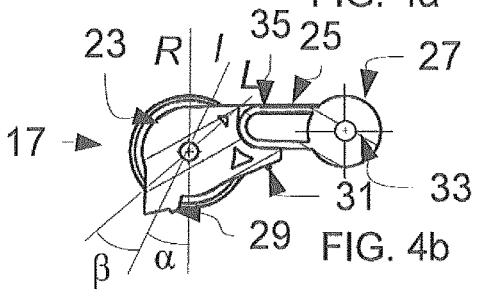
Figure 4C:
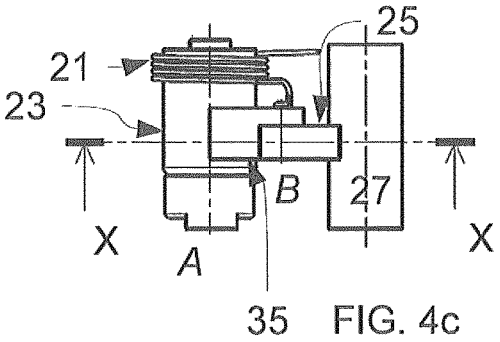
Figure 3:
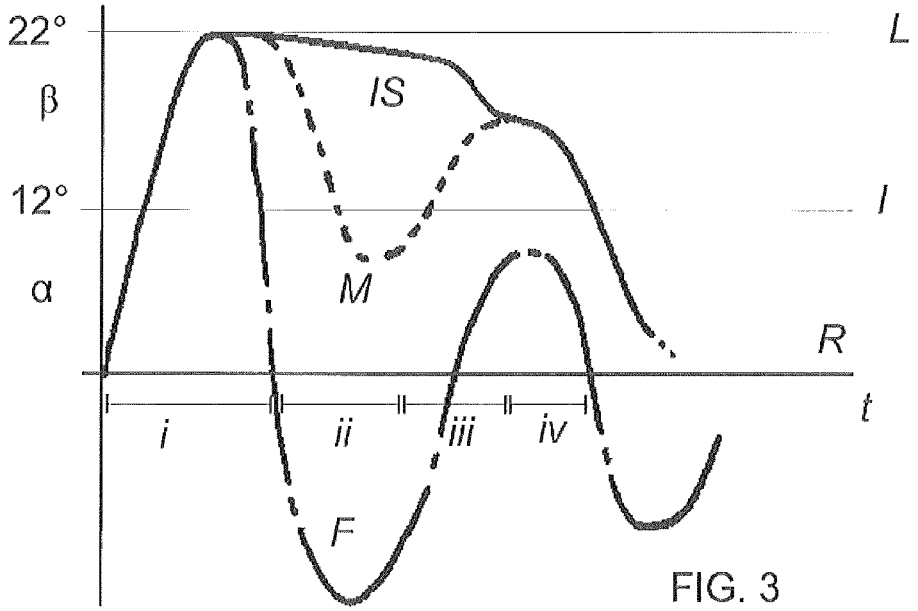
Figure 7:
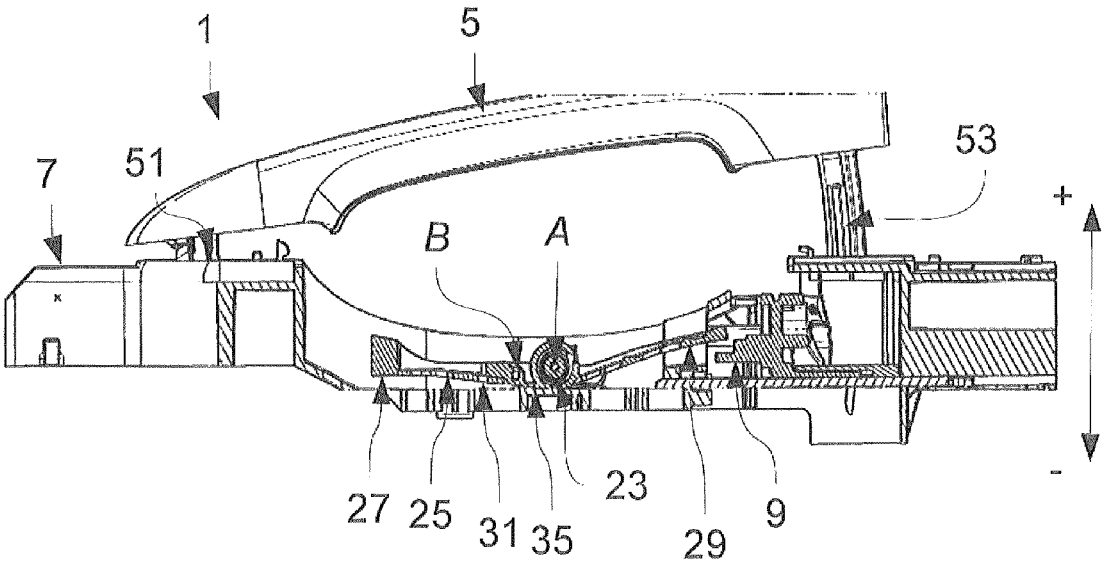
Figure 5A:
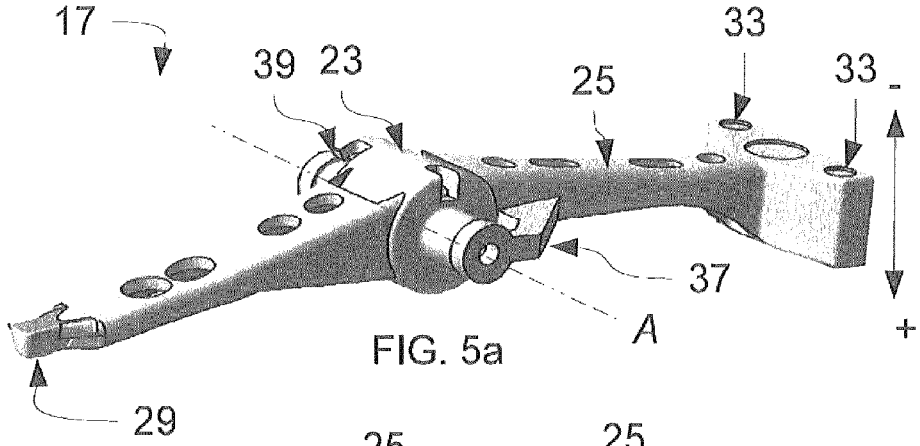
Figure 5B:
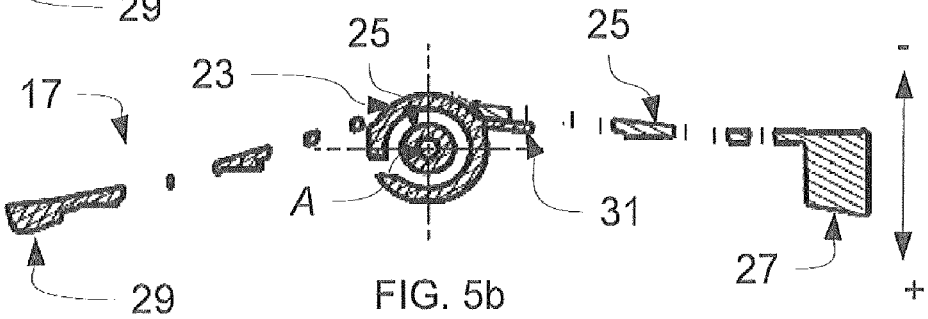
Figure 5C:
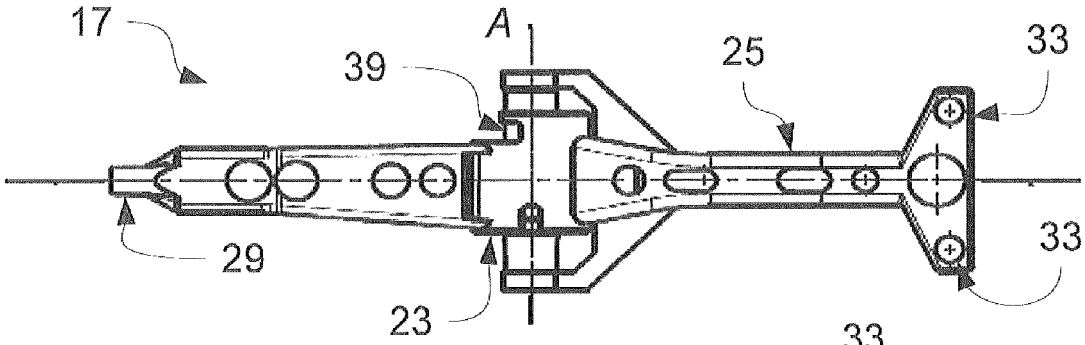
Figure 6:
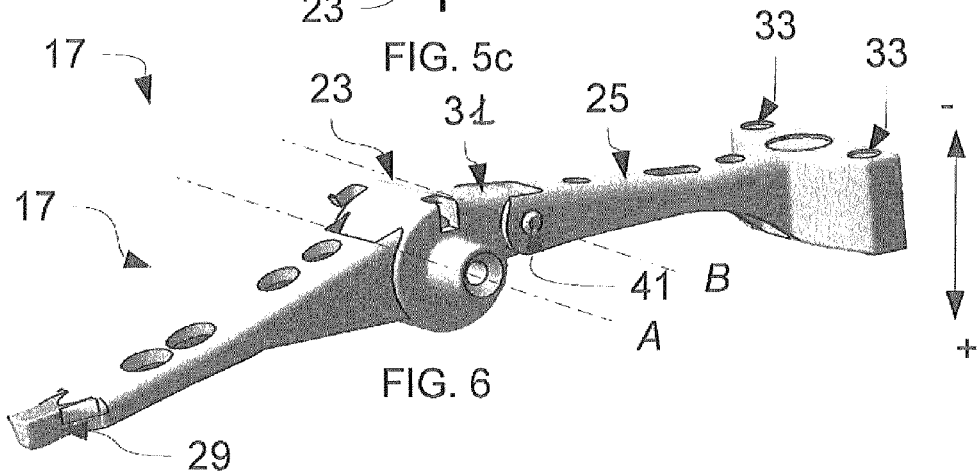
Figure 8:
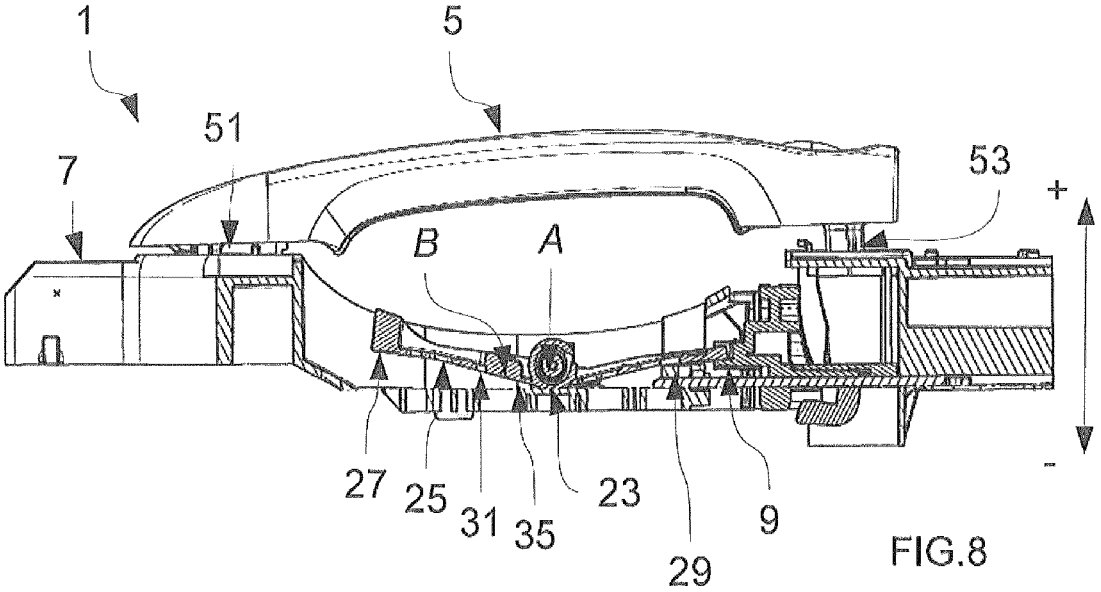
Figure 9:
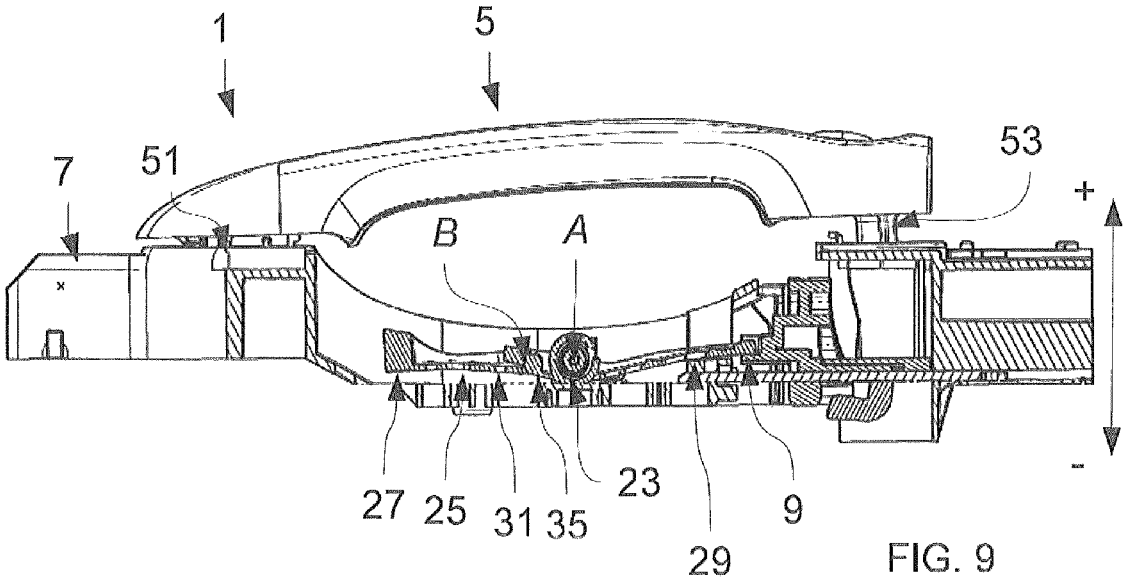

Other characteristics and advantages will appear at the reading of the following description of the surrounded figures, among which:

FIG. 1 is an exploded view of a door handle comprising a system according to the invention, FIGS. 2*a*, 2*b* and 2*c* are views of one embodiment of the inertial system, FIG. 3 is a graph of the angular positions of different elements during a side crash scenario, FIGS. 4*a*, 4*b* and 4*c* are views of a second embodiment of the inertial system, FIGS. 5*a*, 5*b* and 5*c* are views of a third embodiment of the inertial system, FIG. 6 is a view of a fourth embodiment of the inertial system, FIGS. 7, 8 and 9 show the fourth embodiment of FIG. 6 of the door handle and the elements in different steps of a side crash.

On all figures, the same references relate to the same elements.

FIG. 1 depicts the different elements of a vehicle door handle 1 comprising a movement prevention device 3 according to the invention.

The handle 1 comprises a lever 5, mounted mobile in a bracket 7. The lever 5 is placed on the outside of the vehicle door, and is actuated by the user to open the handle 1, for example by rotation of the lever 5 around an articulation in a lever swan neck 51.

The handle 1 comprises an opening mechanism 9, said opening mechanism 9 comprises in the embodiment here depicted, a main lever 11, a lever spring 13, here a coil spring, a bowden cable 15 and the movement prevention device 3.

The opening mechanism 9 is incorporated in the bracket 7. When the user actuates the lever 5, a lever column 53 placed on the side of the lever 5 opposite to the lever swan neck 51 sets the main lever 11 in motion. The main lever 11 in turn actuates the bowden cable 15. The bowden cable 15 then transmits the actuation to the latch located in the door. The lever spring 13 ensures that the main lever 11 returns in initial position afterward.

The movement prevention device 3 comprises an inertial system 17, an inertial system shaft 19, and elastic means 21, here in form of a spring. The shaft 19 is solidly fixed to the bracket 7, and is also fixed to a rotational damper, not represented, inside the inertial system 17.

On FIG. 1 is also depicted a double-arrow, with one end pointing outwards of the vehicle labeled +, and one end pointing inwards of the vehicle labeled –. This arrow defines the relative value of the accelerations and inertial forces, the ones directed outwards being positive, the ones directed inwards being negative. With this convention, a positive inertial force will pull the handle 5 outwards and thus possibly open the door.

One particular embodiment of the inertial system 17 is shown in a more detailed fashion in FIG. 2*a*.

The inertial system 17 comprises a cylindrical body 23 hinged to the inertial shaft 19 around a main rotation axis A, an arm 25 hinged to the cylindrical body 23, and an integrated inertial mass 27 at further end of the arm 25. To block the handle movement when in the blocking angular domain, the inertial system 17 comprises blocking means 29 to interact with corresponding blocking means. The blocking means 29 are here in form of a pin extending radially from the cylindrical body 23.

The spring 21 surrounds the rear part of the cylindrical body 23, and is hardly visible on FIG. 2*a*, with only the free end 22 being visible behind the arm 25. Said free end is destined to cooperate with the bracket 7.

The cylindrical body 23 also comprises a stopper 31, here in form of a shoulder extending radially from the cylindrical body 23, disposed on the path of the arm 25 when said arm 25 is moving in direction of the locking angular domain.

With the aforementioned configuration, the arm 25 when set in motion by positive inertial forces on the inertial mass 27 comes in contact with the stopper 31. The arm 25 then pushes the stopper 31, thus driving the cylindrical body 23 that is solidly bound to the stopper 31 in a blocking position.

On the other hand, if the arm 25, is set in motion by negative forces while the cylindrical body 23 is in a blocking position the inertial mass 27 moves independently from the cylindrical body 23, which remains for a certain period in a locking position since undergoing the effect of a rotational damper integrated in said body 23 (thus non visible) and configured to temporize the return of the inertial system 17 from a locking angular domain to a rest angular domain where the door can be opened.

The integrated inertial mass 27 at the end of arm 25 comprises a socket 33. It is foreseen to insert in said socket 33 an additional weight not represented, to increase and/or tune the inertial mass 27 weight in adequacy with the required engagement time of the movement prevention device 3. Adapting the inertial mass 27 weight value allows to implement a unique embodiment of the inertial system 17 in even more handles, while changing just a weight pin inserted in socket 33.

On FIG. 2*b*, is shown a cut away view of the inertial system 17 of FIG. 2, in a plane orthogonal to the main rotational axis A.

In particular, two adjacent angular apertures $\alpha$ and $\beta$, are represented on FIG. 2*b*. They correspond to two rotational angular domains of the cylindrical body 23 and form respectively a rest angular domain and a locking angular domain.

While the inertial system 17 is within the rest angular domain $\alpha$, the main lever 11 can be actuated freely in order to open the vehicle door. While the inertial system 17 is within the angular aperture, the pin 29 is on the path of a blocker of the main lever 11. Thus, if the inertial system is within the locking angular domain $\beta$, whenever an actuation of the door lever 5 takes place, the blocker is brought in contact with the pin 29, the force applied on door lever 5 bringing the inertial system via the pin 29 and blocker in the extremal locking position L, where said inertial system 17 blocks the movement of main lever 11, and thus opening of the door handle 1.

In the chosen embodiment, for example, the value for $\alpha$ is about 10°, and about 12° for $\beta$. The position represented on FIG. 6 marking the transition from $\alpha$ to $\beta$ is called the intermediary position I.

Once the actuating forces on door lever 5 have decreased, the rotational damper in cylindrical body 23 delays the return of inertial system 17 to rest position R. Said delaying maintains the inertial system 17 for a certain amount of time within the angular aperture $\alpha$. By tuning the rotational damper in comparison to the inertial system spring 21, it is possible to maintain the inertial system during any predetermined amount of time in angular aperture $\alpha$. By choosing said predetermined amount of time between 0.5 and 1 second, the risk of door opening due to a rebound or vibration effect is avoided, while the door can still be opened once the vehicle has stabilized.

In particular, if the inertial mass 27 is pulled by a positive inertial force, corresponding to a direct impact on the side, the arm 25 moves in direction of locking position L and the arm 25 pushes against the stopper 31. Consequently, the inertial mass 27 drives both arm 25 and cylindrical body 23 in direction of locking position L.

If once in locking angular domain $\beta$ the direction of the inertial forces is inverted, due to a rebound, the inertial mass 27 is moved in direction of the rest position R. If the arm 25 moves in said direction, it is released from the stopper 31, and free in rotation towards the cylindrical body 23.

Since the arm 25 can move without driving the cylindrical body 23, said body 23 slowly returns to rest position R since only undergoing the combined efforts of the spring 21 and the damper.

Consequently, the movement prevention device 3 is rendered impervious to negative accelerations that would otherwise possibly overcome the resistance of the damper and bring the cylindrical body 23 back in angular aperture α where the door can be opened, before it is safe.

On FIG. 2*c* is shown a side view of the inertial system, with the line X-X along which the cut away of FIG. 2*b* was realized.

In particular, on said FIG. 2*c* the spring 21 is seen surrounding the cylindrical body 23, the free end 22 being particularly visible. In this embodiment, the spring 21 and the ring shaped base of arm 25 are coaxial with the cylindrical body 23 and surrounds said body 23, thus offering a compact inertial system 17. Alternate embodiments may comprise tubular dampers implemented besides the cylindrical body 23.

In FIG. 3 is depicted the rotation angle of the inertial system 17 as a function of time t in a side crash scenario, the rotation angle of the inertial mass 27 and a relative value of the inertial forces acting on the handle 5.

The graph of the inertial forces is labeled F, the graph of the rotation angle of the inertial system 17 is labeled IS, and the graph of the rotation angle of the inertial mass 27 is labeled M.

The rotation angle is measured with reference to the rest position R. So 0° designates said rest position R, from 0° to 12° the inertial system 17 is in angular aperture α and from 12° to 22° the inertial system 17 is in angular aperture β. An angle of 22° corresponds to the extremal locking position L.

In the rebound scenario, the inertial force describes a curve similar to that of damped oscillations, labeled F on the graph of FIG. 6. At instant t=0, the crash occurs. Almost immediately, the inertial system is brought during step i in extremal locking position L due to the maximal force exerted on it via the stopper 31.

After the initial thrust caused by the direct crash, the inertial forces decrease as the acceleration decreases and the vehicle enters straight translation movement, and then become important again in negative value as a first rebound (due to a rollover, or secondary impact e.g. on sidewalk or tree) or oscillation in reverse direction occurs. The inertial mass 27 stops acting on the stopper 31, thus uncoupling during step ii the movements of the cylindrical body 23 and of the inertial mass 27.

During said step ii the inertial mass 27 is driven back due to the negative forces, but the cylindrical body 23 follows in a much slower movement as its movement is slowed down by the damper. In particular, the inertial mass 27 may be driven back by the inertial forces in the angular domain, while the cylindrical body remains in angular domain β.

In the scenario depicted in FIG. 6, had the cylindrical body 23 and the inertial mass been coupled in decreasing rotation angle value, the inertial mass would possibly have driven the body 23 in domain α at the first rebound in step ii, thus potentially leading to an opening of the door in an inadequate moment.

After the first rebound caused inversion of the inertial forces, a second rebound brings the inertial forces F back in the positive domain in step iii, driving the inertial mass back to higher rotation angle values, where the arm 25 enters in contact with the stopper 31 and consequently the cylindrical body is pushed back to higher rotation angle values in iv, which further delays the return to unlocked state of the handle 1.

FIGS. 4*a*, 4*b* and 4*c* depict an alternative embodiment of the inertial system 17, respectively in perspective, in cut-away view and in a side view, showing in particular the cut away line X-X.

In particular, in this embodiment, the cylindrical body 23 comprises a primary arm 35, said primary arm 35 extending radially from the cylindrical body 23. At the free end of the primary arm 35 are located both the stopper 31, here again in form of a shoulder, and a secondary axis B to which the arm 25 carrying the inertial mass 27 is hinged.

In this embodiment the body 23 and spring 21 are coaxial (axis A), while the arm 25 carrying the inertial mass 27 is articulated to a separate secondary axis B.

FIGS. 5*a*, 5*b* and 5*c* depict a further alternative embodiment of the inertial system 17, respectively in perspective, in cut-away view and in a side view.

The inertial system 17 shown in these figures is built according to an alternative embodiment of the invention. In this embodiment, the pin 29 has roughly the same length than the arm 25 carrying the inertial mass 27 in line with a primary arm 35 to which the arm 25 is articulated. The pin 29 and arms 25, 35 carrying the inertial mass 27 are at an obtuse or reflex angle, here of approximately 160°, the positive direction + perpendicular to the door plane and pointing outwards is approximately a bisector of said angle.

FIG. 5*a* shows in particular that the arm 25 has on its end that does not support the mass 27 a fork 37, comprising two blades ending on both axial ends of the cylindrical body 23. The fork 37 articulates the am 25 to the body 23 at level of main axis A.

The mass 25 has here two holes 33 for respective pins.

Also visible on FIG. 5*a* are holes drilled or punched in the arm 25 and the arm carrying the blocking means 29.

FIG. 5*a* also shows a groove 39 in the cylindrical body 23 in which the free end of spring 21 (not represented) is inserted to fasten it.

In FIG. 5*a*, the stopper located under the arm 25 carrying the mass 27 is not visible. On FIG. 5*b* said stopper 31 is visible.

Since the arm 25 carrying the mass 27 is hinged to main axis A around which the cylindrical body 23 rotates, this embodiment is related to the first embodiment of FIGS. 2*a*, 2*b* and 2*c* . As one may notice, this embodiment does not feature a damper.

FIG. 6 represents a fourth embodiment, derived from the one in FIGS. 5*a*, 5*b*, 5*c*, but in which the arm 25 carrying the mass 27 is articulated to a primary arm 35, thereby suppressing the need for a fork 37.

Since the arm 25 is hinged with a second pin 39 to a primary arm, this embodiment is related to the second embodiment of FIGS. 4*a*, 4*b* and 4*c*, again without damper.

FIGS. 7, 8 and 9 show schematically the elements of the handle 1 with an inertial system 17 as described in FIG. 6 in cut away view, respectively in rest position, during the side crash and during a rebound.

In FIG. 7 the inertial system 17 is in rest position R. This corresponds to the situation before the side crash. In particular, one can see on FIG. 7 that the pin 29 is not engaged in the corresponding mechanical blocking means 37, and thus the lever 5 can be actuated to open the handle 1.

In FIG. 8 the inertial system 17 is in locking position L. This corresponds to the situation during the side crash, before a rebound occurs. In particular, the pin 29 is here engaged in the latch mechanism 9, preventing actuation of handle 1 by pulling the lever 5 since driven by the inertial mass 25, which led the arm 25 against stopper 31 and thus pushed the pin 29 in interaction with the latch mechanism 9 to prevent actuation of handle lever 5.

In FIG. 9, the rebound is occurring : the inertial forces applied on the different elements are now pointing in inward, negative, direction –. The inertial mass 27 carrying arm 25 is in particular pulled inwards (– direction) by said forces. Since the arm 25 carrying said inertial mass 27 is articulated to the primary arm 35, it moves in said direction without influencing the position of the pin 29, which remains engaged with the latch mechanism 9.

As a matter of fact, the particular layout of the inertial system 17, with the pin 29 and the arms 25, 35 forming an obtuse or reflex angle roughly centered on the outwards pointing direction +, causes the pin to maintain or return to locking position L automatically in case of negative inertial forces, thus preventing the need for a rotational damper.

The invention allows to selectively uncouple the mass 27 from the inertial system 17 when the inertial forces would otherwise lead to an unlocking of the movement prevention device 3, and thus risking an opening of the door during the rebounds.

The invention works with both damped and non-damped reversible inertial systems 17, and can be adapted on various already existing designs as an additional feature.

Also, the invention only implies minor modifications and additional pieces as compared to state of art, therefore only implying small price raises while improving overall security in the event of a side crash.

The invention claimed is:

1. A vehicle door handle, comprising:

an inertial system mobile in rotation around a main rotation axis and configured for activating and preventing the actuation of the door handle, wherein the inertial system comprises:

a cylindrical body receiving the main rotation axis, a mobile part comprising an inertial mass, the mobile part being mobile in rotation relative to the cylindrical body around a secondary axis parallel to the main rotation axis and is directly connected to the cylindrical body at the secondary axis, and means for stopping the rotation of the mobile part in a predetermined direction, wherein the inertial system is mobile in rotation around the main rotation axis between a locking angular domain in which blocking means of said inertial system interfere with an opening mechanism to prevent actuating the door handle, and a rest angular domain in which the door handle can be freely actuated, and elastic means are configured to bring the inertial system back to its rest angular domain in absence of acceleration.

2. The vehicle according to claim 1, wherein the means for stopping the rotation of the mobile part comprises a stopper located on the side of the cylindrical body and configured for blocking the movement of the mobile part.

3. The vehicle according to claim 1, wherein the body comprises a primary arm, said primary arm extending radially from the cylindrical body, wherein the cylindrical body also carries the blocking means, the mobile part being a secondary arm hinged to the primary arm at the secondary axis and extending radially from said axis, the inertial mass being supported at the free end of the secondary arm, the means for stopping the rotation of the mobile part comprises a stopper that is located on the side of the cylindrical body configured to engage with the secondary arm when said secondary arm is moving in direction of the locking angular domain, and to let the secondary arm move freely in the direction of the rest angular domain.

4. The vehicle door handle according to claim 2, wherein the stopper comprises a shoulder extending radially from the cylindrical body.

5. The vehicle door handle according to claim 1, further comprising a rotational damper, configured to temporize the return of the inertial system from the locking angular domain to the rest angular domain.

6. The vehicle door handle according to claim 5, wherein the damper mechanism is a rotational damper integrated in the cylindrical body.

7. The vehicle door handle according to claim 1, wherein the elastic means comprise a coil spring surrounding the cylindrical body.

8. The vehicle door handle according to claim 3, wherein the primary arm and the secondary arm carrying the inertial mass are formed at an obtuse or reflex angle on an outwards pointing direction, and wherein the outwards pointing direction is a bisector of the obtuse or reflex angle and is perpendicular to a door.

9. The vehicle door handle according to claim 8, wherein the angle between the primary arm and arm carrying the inertial mass is 160°.

10. The vehicle door handle according to claim 1, wherein the inertial mass comprises a socket in which a pin can be inserted to tune the weight of inertial mass.

* * * * *